US005909869A

United States Patent [19]

Sandøy et al.

[11] Patent Number: 5,909,869

[45] Date of Patent: Jun. 8, 1999

[54] RAM WINCH

[75] Inventors: Harry Sandøy, Kolbjørnsvik; Vidar Solstad, Fevik, both of Norway

[73] Assignee: Maritime Pusnes AS, Faervik, Norway

[21] Appl. No.: 08/927,385

[22] Filed: Sep. 12, 1997

[51] Int. Cl.[6] ..... B66D 1/00

[52] U.S. Cl. ..... 254/264; 254/228

[58] Field of Search ..... 254/264, 384, 254/228, 251, 252, 256, 257, 385, 386, 108, 109, 110, 111

[56] References Cited

U.S. PATENT DOCUMENTS

| | | | |
|---|---|---|---|
| 2,658,720 | 11/1953 | Coffing | 254/264 |
| 2,658,723 | 11/1953 | Coffing | 254/264 |
| 3,284,051 | 11/1966 | Belanger | 254/264 |
| 3,524,269 | 8/1970 | Jackoboice | 254/264 |
| 3,845,935 | 11/1974 | Chambers . | |
| 4,183,502 | 1/1980 | Skaalen . | |
| 4,456,226 | 6/1984 | Stumpmeier | 254/264 |
| 5,054,744 | 10/1991 | Essex | 254/228 |

FOREIGN PATENT DOCUMENTS 146530 7/1982 Norway .

*Primary Examiner*—John M. Jillions
*Attorney, Agent, or Firm*—Andrus, Sceales, Starke & Sawall

[57] ABSTRACT

A device for heaving in chain (2,3) vertically by means of a locking device for the chain comprises one or more pawls (14,14') which engage the chain (2,3) in a combined hydraulic lifting (8) and gripping device (12) with an equivalent pawl system and an approximately 180° guide device (1) for the chain. The guide device (1) and the lifting (8) and gripping device (12) are integrated in one unit in that the semicircular guide device (1) is hinged in the area which is furthest away from the incoming part of the chain, and that the gripping device consists of one or more pawls (12) which can hold the chain while it lies in its track (4,5) in the guide device (1). A hydraulic lifting cylinder (8) is hinged to the guide device (1) close to the incoming part of the chain.

32 Claims, 5 Drawing Sheets

Figure 2:
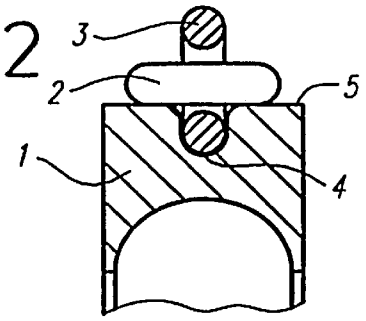

1
2
3
4
5

1
2
3
3'
3''
3'''
3''''
4
6
7
8
9
10
11
12
13
14
14'
15
15'
16
17
18
2'
2''
A
A

RAM WINCH

The present invention concerns a device for heaving in and lowering out chains using one or more hydraulic cylinders which, by means of gripping and locking devices, grip the chain and lift or lower it a little while the locking device is disengaged. When the cylinder approaches the other end of its stroke, the locking device is re-engaged, the gripping device is released from the chain and, after the hydraulic cylinder has returned to its initial position, the gripping device is ready to grip again.

The invention also comprises a 180° guide device for the chain. The device is especially suitable for anchor chains.

Several such types of linear winches for chains exist. They usually consist of three separate units:

A locking device for chains.

A cylinder device connected to a gripping device for the chain. The cylinder device can lift or lower the chain a little more than two chain links.

A 180° guide device for the chain which is raised/lowered vertically back to a parallel vertical direction towards a box or similar for storing the chain.

The locking device and gripping device are often arranged according to the same principle: one or two pawls which engage with every other chain link using the force of gravity, springs or similar. When the chain is lifted, the pawl(s) move(s) aside, but the pawl(s) will fall back in place when the chain is lifted two chain links.

Such devices only work for heaving in the chain. If the chain is to be lowered out, the pawls in the locking device and gripping device must be operated separately, for example by means of hydraulic auxiliary cylinders.

Cylinder devices having two parallel cylinders can give problems regarding the synchronization thereof, while a device having one cylinder can cause high bending moments on the piston rod. Cylinders where the working pressure acts on the rod side of the piston (the piston rod is pulling) provide reduced power as compared to cylinders where the working pressure acts on the entire piston (the piston rod is pushing).

There is one linear winch at the bottom of which is arranged a locking device consisting of two hydraulically operated pawls which drag on the lower curve of a chain link, each being on one side of the underlying chain link. Two chain links above the locking device there is a gripping device consisting of equivalent hydraulically operated pawls. The gripping device can be moved further upwards equivalent to two chain links using two hydraulic cylinders. Above this area, the chain passes through 180° over a guide pulley, and the weight of the chain hanging down will keep the chain taut after it has passed over the linear winch. Norwegian patent No. 146530 is an example of such a type and is instinctive in that the two pawls in both the gripping and locking devices are synchronized by means of toothed segments.

In another known linear winch, the gripping device is arranged at the bottom in the centre on a beam which is suspended at both ends from piston rods from two hydraulic cylinders. The two cylinders are fastened on each side by a beam which is, in turn, fastened to the structure of an offshore platform, ship or similar. The locking device for the chain is mounted in the centre of this fixed beam, and above the locking device a guide device is arranged which can guide the chain through 180° back to a vertical direction.

Two linear winches are known which utilize only one working piston where the working pressure acts on the entire piston surface.

U.S. Pat. No. 3,845,935 shows a device where the piston rod is stationary and the gripping device is attached to the cylinder. Since the chain force causes a high bending moment in the piston rod, the latter is very robust. For the cylinder there are provided two bearing supports arranged at considerable distance from the piston rod, which increases the total length substantially. The patent does not show any 180° guide device for the chain, but this will be necessary if the device is to be used for anchor chains.

In U.S. Pat. No. 4,183,502 one has attempted to avoid the bending moment in the piston rod by placing the working cylinder centrally between two chains. However, this arrangement is not optimal in that the two anchor chains often will have substantially different loads. The locking and gripping device is not pawls, but two parallel axles pushed in on either side of a chain link in order to lock the link above.

The present invention makes possible a simpler linear winch for a chain as fewer components are used and less space is required. It is possible to use only one working cylinder where the working pressure acts on the entire piston surface and the piston rod is not subjected to bending moments.

The holding or locking device can be as in the previously known designs, while the gripping device is part of a 180° guide device which is hinged in the area where the chain runs out of the linear winch in the direction towards the chain box. Close to the area of the guide device where the chain runs in, there is a bracket for a piston rod of a hydraulic cylinder which can lift this end of the guide device equivalent to two chain links and a little more. The guide device has a track for the "vertical" chain links. The gripping device for the chain preferably consists of a pawl which presses the curve of a vertical chain link in the heave direction along the reference circle in the guide device but also in towards the track in the guide device.

The gripping device may also consist of two pawls which press against the curve of a horizontal link on each side of a vertical link.

The 180° guide device for the chain from vertical upwards to vertical downwards is a common feature of linear winches, but the invention can also work with deviations from the two stated vertical directions and the need for a bending angle in the guide device will vary accordingly.

On account of the tipping movement when the device is in operation, the 180° contact angle of the chain with the guide device should be increased according to the tipping movement in order for the chain to be in contact also when the tipping movement is at its greatest and the guide device is in the upper position. The guide path for the increased contact angle should have a constant radius to the tipping centre in order that the direction of the chain towards the locking device is unchanged during the tipping movement.

A hydraulic cylinder is described above for the activation of the tipping movement, but the activation device may be any linear actuator.

The activation device and gripping device are used only when the chain length needs adjustment. They can be made portable and can thus serve several linear winches.

The height above deck can be further reduced if the linear winch is positioned on a structure where the incoming chain is outside a vertical side plate, for instance on a column of an offshore platform. The support for the 180° guide device can then be positioned on a relatively small bracket on deck, while the foundation for the holding device and the activating cylinder is a bracket welded to the side of the column.

The present invention will be described in further detail with reference to FIGS. 1–5. The figures are intentionally simplified in order to show the essential aspects of the invention.

Figure 1:
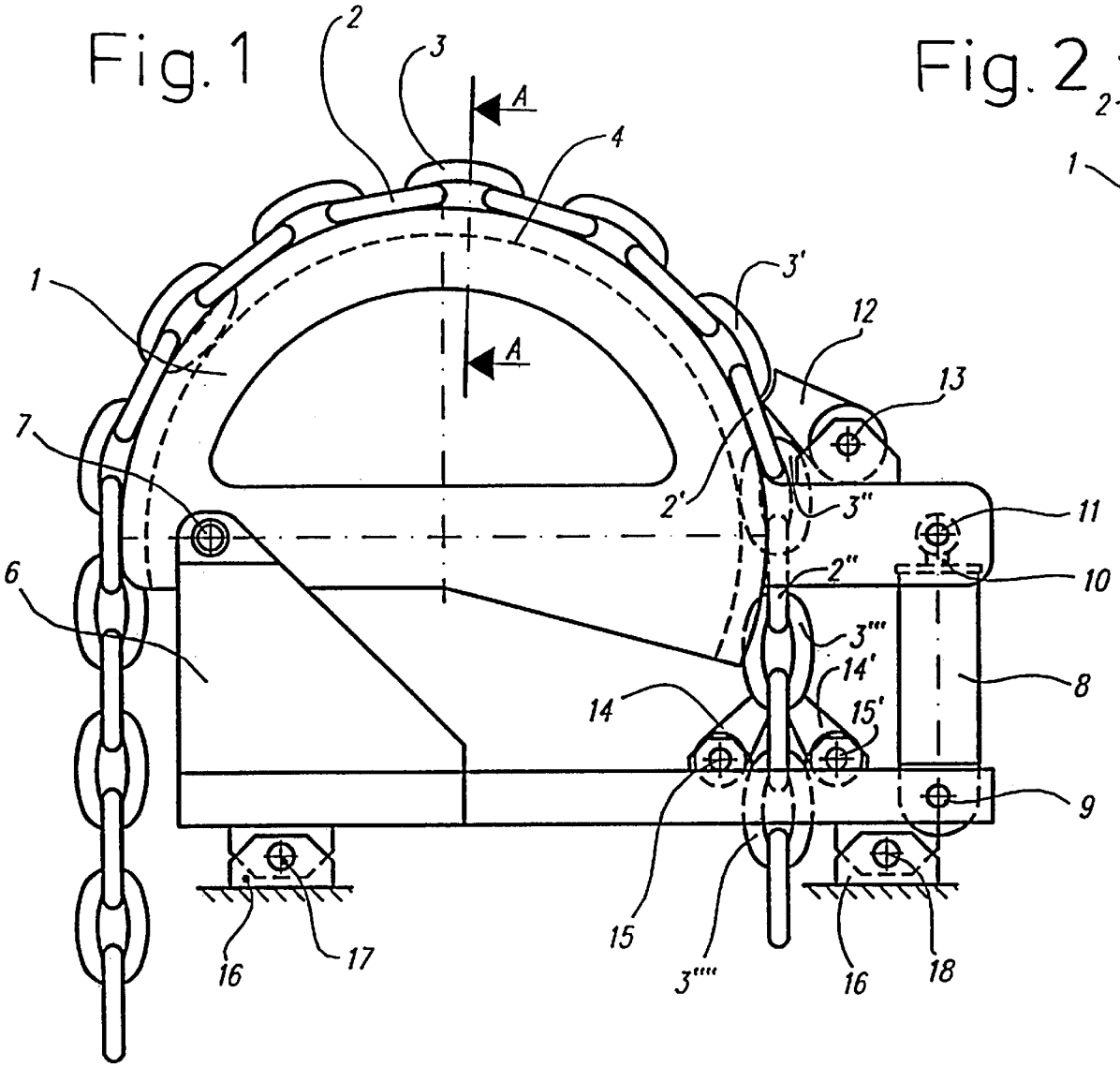
Figure 3:
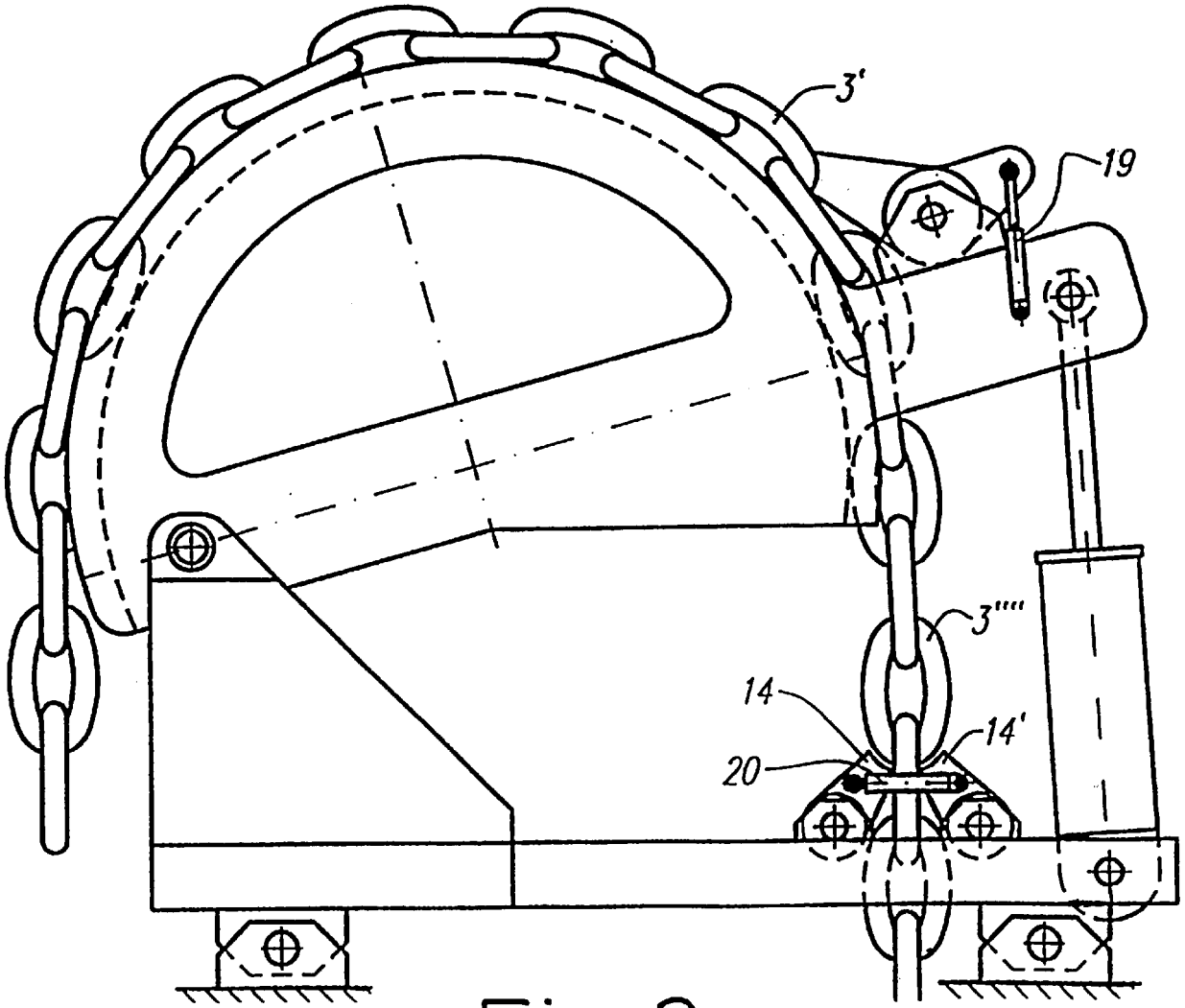
Figure 4:
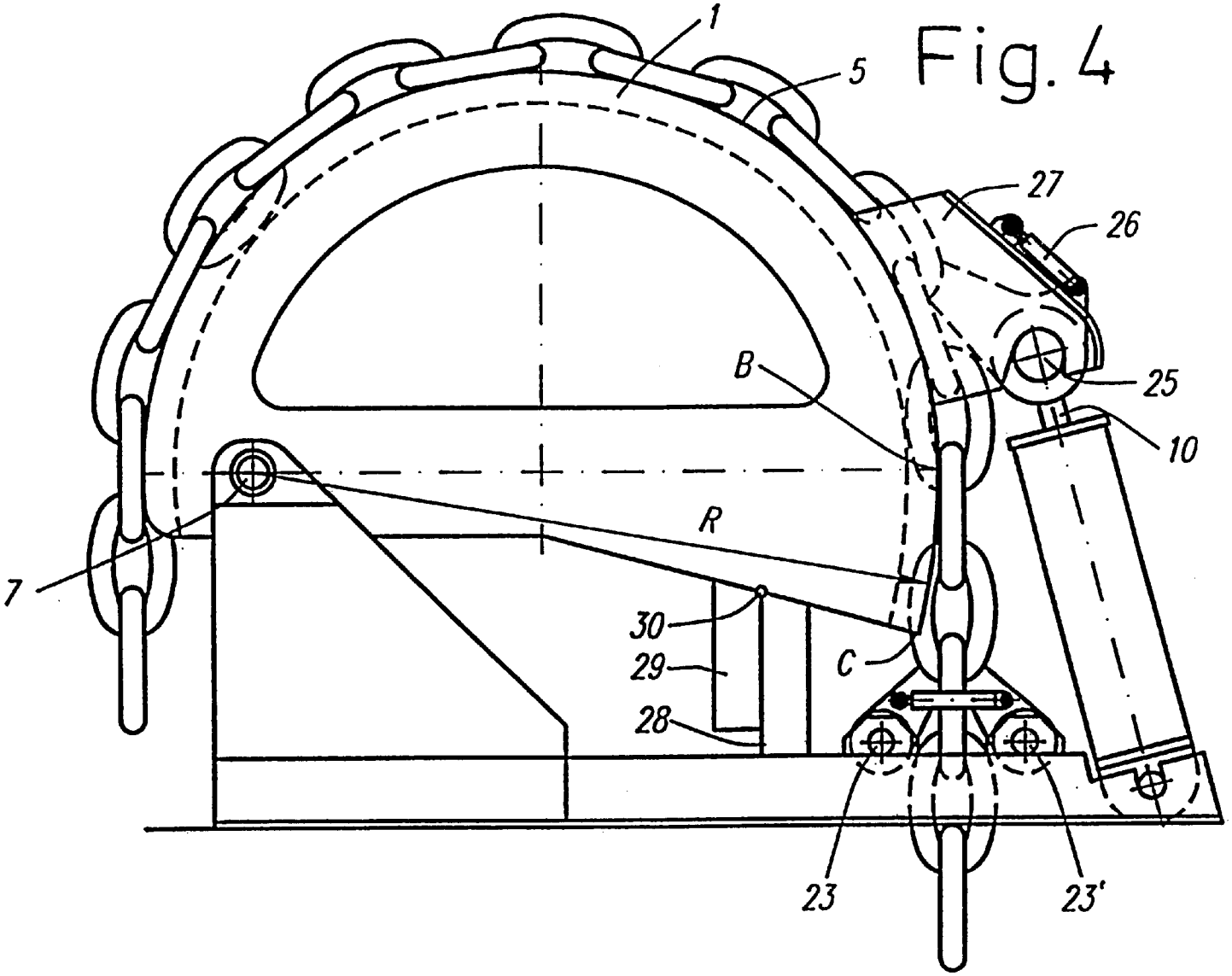
Figure 5:
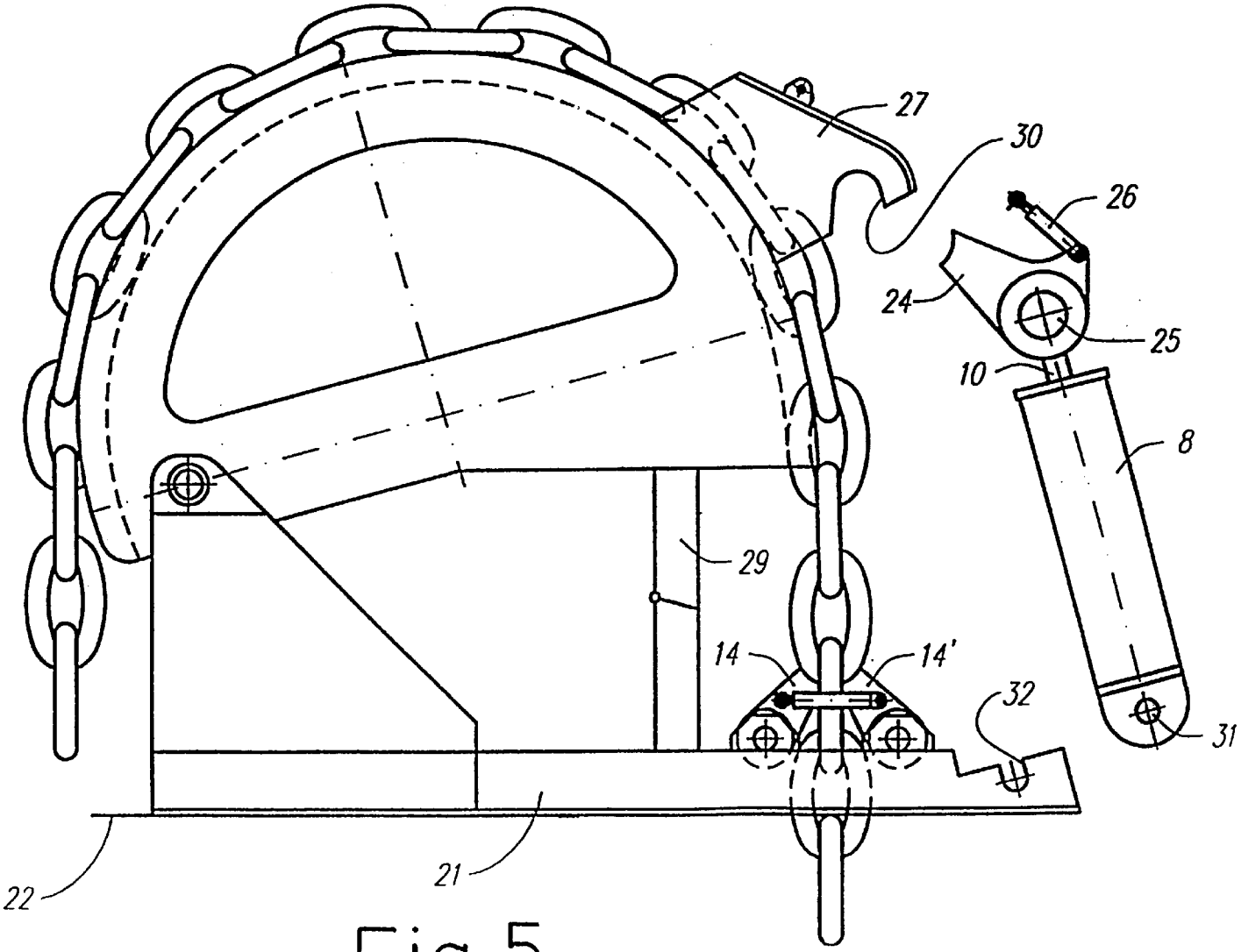
Figure 6:
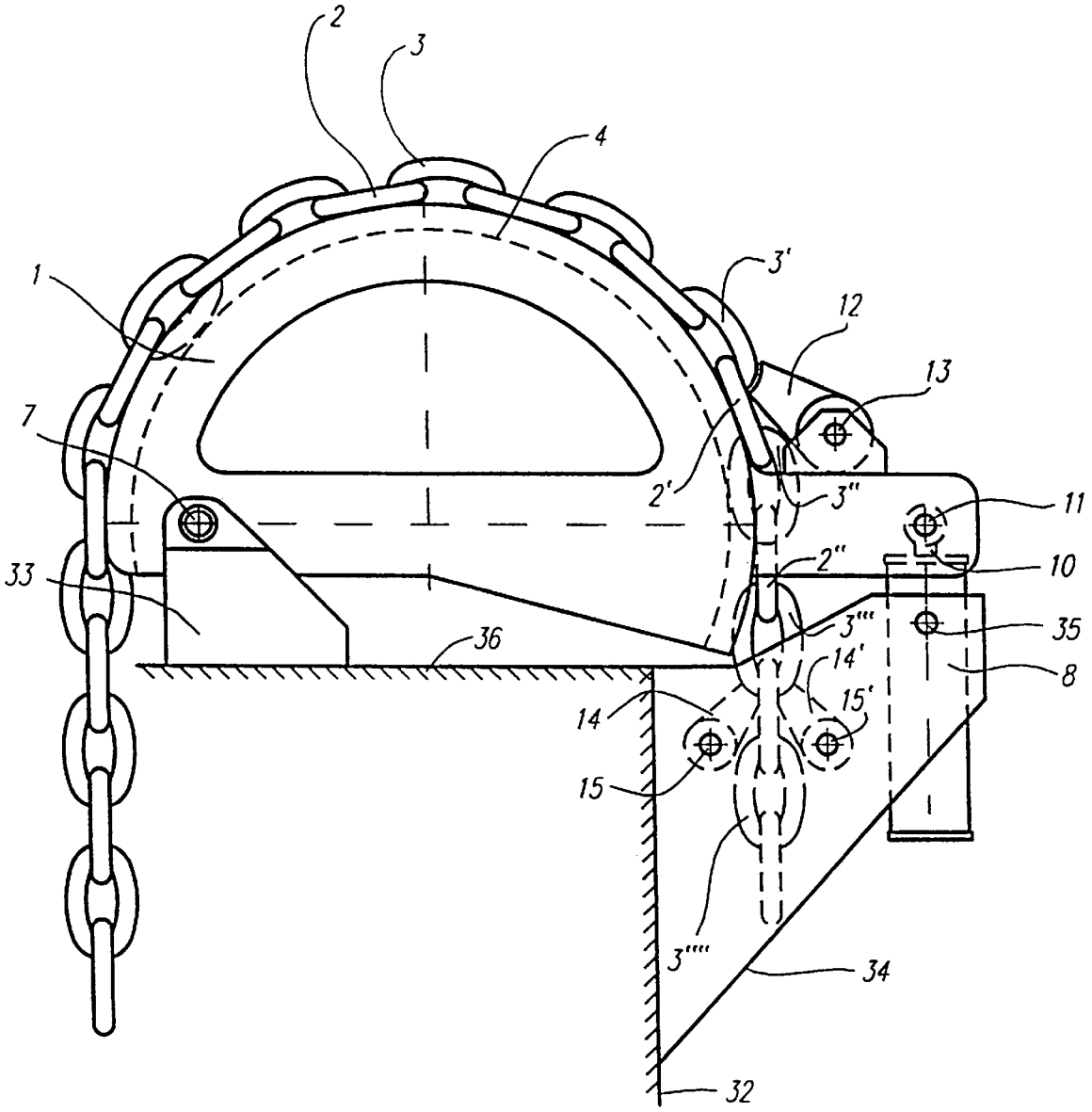

FIG. 1 shows a side view of a linear winch according to the invention in passive condition, FIG. 2 shows a section along the line A—A in FIG. 1, FIG. 3 shows the linear winch of FIG. 1 in activated condition, FIG. 4 shows a side view as in FIG. 1 of another embodiment of the linear winch according to the invention, FIG. 5 shows the linear winch of FIG. 4 in a second position, and FIG. 6 shows a version where the linear winch is positioned on a column of an offshore platform.

FIG. 1 shows a chain which, in relation to the guide device 1, consists of horizontal 2 and vertical 3 chain links. The guide device has a track 4 for the vertical chain links while the horizontal links rest on the periphery 5 of the semicircular guide device 1; see also FIG. 2. The guide device is hinged to the frame 6 by a through bolt 7. A hydraulically operated lifting/lowering cylinder 8 is hinged to the frame 6 by a bolt 9 and the piston rod 10 of the cylinder 8 is hinged to the guide device by a bolt 11. The piston rod is shown close to the base position in the figure, i.e. almost completely inserted. The gripping device consists of a pawl 12 which has a small clearance to a vertical chain link 3' and it drags on a horizontal link 2'. The pawl 12 is hinged to the guide device 1 by a bolt 13.

The locking device for the chain consists of two pawls 14,14' which drag on the vertical chain link 3'''. The pawls are hinged to the frame 6 by two bolts 15,15'. The frame 6 can be fastened to the base 16 but the drawing shows a hinged connection by means of horizontal bolts 17,18. The bolt 18, which is close to the loaded part of the chain, is preferably a cylindrical load cell which makes it possible to monitor the strain in the chain for all load conditions.

FIG. 2 is a section along the line A—A in FIG. 1. The vertical links 3 have support in the base of the track 4 so that the horizontal links 2 are not subject to bending stresses when the chain under tension rests against the periphery 5.

FIG. 3 shows the piston rod 10 in its top position, i.e. completely extended. The pawls 14,14' in the locking device have a small clearance to the chain link 3'''. An auxiliary cylinder 19 for operating the gripping device and an auxiliary cylinder 20 for operating the locking device are also shown.

FIGS. 4 and 5 show an embodiment in which the periphery 5 of the guide device 1 is extended along a radius R with its centre in the bolt 7. The extension of the periphery 5 extends from point B, which is the chain's tangent point with the guide device 1 towards the locking device 14,14' when the piston rod 10 in the cylinder 8 is in its base position, to point C, which is the equivalent tangent point when the piston rod 10 is in its top position. The frame 21 can be welded or bolted to the deck 22. One or more bolts for the pawls 14,14' is/are replaced with cylindrical load cells 23,23'. The pawl 24 for the gripping device is connected to the rod head of the cylinder 8 by the through bolt 25. The auxiliary cylinder 26 is fastened on a swivel mounting to the boss for the pawl 24 at one end and to a sliding bracket 27 welded to the guide device 1 at the other end.

FIG. 4 also shows that the guide device 1 is supported firmly by a fixed abutting piece 28 when the chain is suspended in the locking device 14,14'. An extension 29 of the abutting piece 28 is the hinge 30 of the abutting piece 28 and in the figure it is swivelled to the unloaded position.

In FIG. 5 the guide device 1 has been moved to the top position, the extension 29 of the abutting piece has been swivelled upwards to make contact with the abutting piece 28 and the piston rod 10 has been moved back a little so that the guide device 1 rests on the extension 29 of the abutting piece and the chain is suspended in the locking device 14,14'.

The auxiliary cylinder 26 has been loosened from the sliding bracket 27 and the piston rod 10 has been moved back to the base position. As a result, the bolt 25 has been moved out of the slit track 30 in the sliding bracket 27. The cylinder 8 with parts which are fixed in it has been lifted so that the pendulum bolt 31 has been pressed out of its slit track 32. As a result, the cylinder 8 can be used to activate several linear winches. If they are in the same area, it is not necessary to disconnect the hydraulic connection hoses (not shown) to operate the cylinders 8 and 26. Alternatively, the bolts 25 and 31 can be pulled out axially and there is then no need for the slit tracks 30,32.

FIG. 6 is similar to FIG. 1, but modified for fitting on a column of a rig. The deck 36 of the column meets the vertical side 32 of the column. The guide device 1 is linked to bracket 33 by the bolt 7. The bracket 33 is welded to the deck 36. The pawls 14,14' are linked to the bracket 34 by bolts 15,15' and the cylinder 8 is linked to the bracket 34 by cantilever axles 35,35'. The bracket 34 is welded to the side 32 of the column.

The procedure for heaving in the chain will be described with reference to FIGS. 1 and 3. The chain link 30''' is locked by pawls 14,14' as shown in FIG. 1 and holds the part of the chain below. The cylinder 8 is subjected to hydraulic pressure and will press the right end of the guide device 1 upwards while the latter rotates around the bolt 7. The chain 2,3 through 3''' then slides a little towards the guide device 1 until the pawl 12 makes contact with the chain link 3' and the chain follows the guide device 1. As the chain is lifted, the vertical link 3''' will press the pawls 14,14' aside so that it can pass. When the stroke of the cylinder 8 is at a maximum, the chain link 3''' has passed the pawls 14,14' and they return to the starting point just under the link 3'''. FIG. 3 shows this position. The strain in the chain is held temporarily by the pawl 12 in the gripping device, but when the piston rod in the cylinder 8 is pulled slightly back, the locking device 14,14' will hold the vertical chain link 3'''. The gripping device 12 is thus relieved and the pawl 12 will be lifted off the vertical chain link 3'' and slide into place under this link 3'' when the cylinder 8 approaches the base of its stroke.

The process requires that the weight of the chain in the outgoing part is large enough to overcome the frictional force of the chain, which must slide against the guide device 1.

Please see FIG. 3 for the lowering of the chain. The piston rod 10 in the cylinder 8 is extended fully and the chain is then suspended on the pawl 12 in the gripping device. The pawls 14,14' are moved out using the auxiliary cylinder 20. The piston rod 10 is pulled back until it approaches its base position and the pawls 14,14' are moved to the locking position using the cylinder 20. The pawl 12 in the gripping device is disengaged from the vertical chain link 3' using the auxiliary cylinder 19 and the piston rod 10 is extended until it approaches its top position. The pawl 12 is engaged using the auxiliary cylinder 19 and the cycle is completed when the piston rod 10 is fully extended.

We claim:

1. A device for heaving in a chain (2, 3), comprising a frame (6, 33, 34) wherein a locking device is arranged for the chain and having one or more pawls (14, 14') which engage the chain (2, 3), a gripping device, a lifting device (8) for the chain (2, 3), and a rounded guide device (1) having a track for the chain and being pivotally supported in said frame at a supporting point, characterized in that the guide device (1) is shaped substantially like a semicircle and defines a track, that the lifting device cooperates with a portion of the periphery of the guide device (1) which lies substantially diametrically opposite to the supporting point (7) of the guide device (1) in the frame (6, 33, 34) and comprises a linear actuator (8) which acts on said portion of the guide device (1), and that the gripping device comprises one or more pawls (12, 24) which can hold the chain while lying in the track (4, 5) in the guide device (1).

2. A device according to claim 1, characterized in that the linear actuator (8) is constituted by a single hydraulic lifting cylinder.

3. A device according to claim 1, characterized in that the pawls (14,14';12) in the locking device and gripping device are operable by means of hydraulic auxiliary cylinders (19,20).

4. A device according to claim 1, characterized in that the periphery of the substantially semicircle-shaped guide device (1), in an area where the chain (2,3) comes into contact during the stroke of the actuator (8), has constant radius with its centre in the supporting point (7) for the guide device (1) in the frame (6).

5. A device according to claim 1, characterized in that the guide device (1) rests against an abutment (28) at its lower position.

6. A device according to claim 1, characterized in that the guide device (1) has an activatable abutment (29) near its upper position, and that the lifting device (8) has pendulum support bolts (25,31) at both ends which are supported in respective slit tracks (30,32) which open in the direction of the actuator (8).

7. A device according to claim 1, characterized in that the gripping device (12,24) is arranged at said portion (27) of the guide device (1).

8. A device according to claim 1, characterized in that the guide device (1) is supported by a bracket (33) fixed to a horizontal deck (36) of an offshore platform, and that the locking device (14,14') and the linear actuator (8) are supported by a bracket (34) which is fixed to a vertical side (32) adjacent to the horizontal deck (36).

9. A device according to claim 2, characterized in that the gripping device includes a pawl (24) which pivots about the same axis as a pendulum support (25) for the head of the piston rod (10) of the hydraulic lifting cylinder (8).

10. A device according to claim 2, characterized in that the hydraulic lifting cylinder (8) is pivotally supported in the frame (6,34) by means of bolts (35,35') extending from the cylinder.

11. A device according to claim 2, characterized in that the pawls (14,14';12) in the locking device and gripping device are operable by means of hydraulic auxiliary cylinders (19,20).

12. A device according to claim 2, characterized in that the periphery of the substantially semicircle-shaped guide device (1), in the area where the chain (2,3) comes into contact during the stroke of the actuator (8), has constant radius with its centre in the supporting point (7) for the guide device (1) in the frame (6).

13. A device according to claim 2, characterized in that the guide device (1) rests against an abutment (28) at its lower position.

14. A device according to claim 2, characterized in that the guide device (1) has an activatable abutment (29) near its upper position, and that the lifting device (8) has pendulum support bolts (25,31) at both ends which are supported in respective slit tracks (30,32) which open in the direction of the actuator (8).

15. A device according to claim 2, characterized in that the gripping device (12,24) is arranged at said portion (27) of the guide device (1).

16. A device according to claim 2, characterized in that the guide device (1) is supported (7) by a bracket (33) fixed to a horizontal deck (36) of an offshore platform, and that the locking device (14,,14') and the linear actuator (8) are supported by a bracket (34) which is fixed to a vertical side (32) adjacent to the horizontal deck (36).

17. A device according to claim 7, characterized in that gripping device includes a pawl (24) which pivots about the same axis as a pendulum support (25) for the head of the piston rod (10) of the hydraulic lifting cylinder (8).

18. A device according to claim 7, characterized in that the linear actuator (8) is pivotally supported in the frame (6,34) by means of bolts (35,35') extending from the linear actuator.

19. A device according to claim 7, characterized in that the guide device (1) has an activatable abutment (29) near its upper position, and that the lifting device (8) has pendulum support bolts (25,31) at both ends which are supported in respective slit tracks (30,32) which open in the direction of the actuator (8).

20. A device according to claim 7, characterized in that the guide device (1) is supported (7) by a bracket (33) fixed to a horizontal deck (36) of an offshore platform, and that the locking device (14,14') and the linear actuator (8) are supported by a bracket (34) which is fixed to a vertical side (32) adjacent to the horizontal deck (36).

21. A device for lifting or lowering a chain, comprising:

support structure;

a guide member pivotably mounted to the support structure for movement about a pivot axis, wherein the guide member defines a chain engagement surface spaced from the pivot axis;

an extendible and retractable actuator interconnected between the support structure and the guide member at a location spaced from the pivot axis for imparting movement to the guide member about the pivot axis in opposite directions;

a gripping arrangement operable to engage the chain with the chain engagement surface of the guide member when the actuator is operated so as to move the guide member in a first direction, resulting in movement of the chain in the first direction; and a locking arrangement operable to maintain the position of the chain relative to the guide member when the actuator is operated so as to move the guide member in a second direction opposite the first direction.

22. The device of claim 21, wherein the guide member defines an arcuate periphery and wherein the chain engagement surface is formed on the arcuate periphery of the guide member.

23. The device of claim 22, wherein the arcuate periphery includes a track arrangement for receiving the chain.

24. The device of claim 22, wherein the chain is engaged about the arcuate periphery of the guide member between first and second sides defined by the guide member, and wherein the pivot axis is located between the first and second sides of the guide member.

25. The device of claim 21, wherein the gripping arrangement comprises a pawl member pivotably mounted to a structural member interconnected with and extending outwardly from the guide member past the chain engagement surface, and wherein the actuator is interconnected between the support structure and the structural member.

26. The device of claim 25, wherein the locking arrangement comprises a pair of locking pawl members pivotally mounted to the support structure below the structural member and the gripping arrangement pawl member, wherein the locking arrangement pawl members are pivotably movable between an engaging position in which the locking arrangement pawl members engage the chain for maintaining the chain in position, and a disengaging position for enabling movement of the chain relative thereto.

27. A device for lifting or lowering a chain, comprising:

support structure;

a guide member movably mounted to the support structure and defining a chain engagement surface;

a gripping arrangement operable to selectively engage the chain with the chain engagement surface of the guide member;

a locking arrangement operable to selectively maintain the position of the chain relative to the guide member;

an extendible and retractable actuator interconnected between the support structure and the guide member for selectively imparting movement to the guide member in opposite directions, wherein the gripping arrangement is operable to engage the chain with the chain engagement surface of the guide member when the actuator is operated so as to move the guide member in a first direction, and wherein the locking arrangement is operable to maintain the position of the chain relative to the guide member when the actuator is operated so as to move the guide member in a second direction opposite the first direction; and a first releasable engagement arrangement interposed between the support structure and the actuator and a second releasable engagement arrangement interposed between the guide member and the actuator, wherein the actuator is extendible so as to move the guide member relative to the support structure and the locking arrangement is operable to maintain the position of the chain relative to the guide member and the support structure, and wherein retraction of the actuator is operable to release engagement of the actuator from the support structure and the guide member via the first and second releasable engagement arrangements.

28. The device of claim 27, wherein the first engagement arrangement comprises a recess associated with the support structure for receiving an elongated mounting member associated with the actuator and receivable within the recess.

29. The device of claim 27, wherein the guide member includes a structural member interconnected therewith and extending outwardly from a peripheral edge defined by the guide member with which the chain is engageable, and wherein the second releasable engagement arrangement is interposed between the actuator and the structural member.

30. The device of claim 29, wherein the second releasable engagement arrangement comprises a recess formed in the structural member and an elongated mounting member associated with the actuator and receivable within the recess.

31. The device of claim 29, wherein the guide member is pivotably mounted to the support structure for movement about a pivot axis and defines an arcuate outer surface with which the chain is engageable.

32. The device of claim 31, wherein the gripping arrangement is mounted to the structural member and includes a pivotable pawl for selective movement relative to the chain for selectively maintaining the chain in engagement with the outer surface of the guide member.

* * * * *